US010276121B2

(12) United States Patent
Kim et al.

(10) Patent No.: US 10,276,121 B2
(45) Date of Patent: Apr. 30, 2019

(54) GATE DRIVER WITH REDUCED NUMBER OF THIN FILM TRANSISTORS AND DISPLAY DEVICE INCLUDING THE SAME

(71) Applicant: LG Display Co., Ltd., Seoul (KR)

(72) Inventors: Byunghoon Kim, Paju-si (KR); Yongho Kim, Seoul (KR); Kwangsoo Kim, Seoul (KR); Seungchul Lee, Incheon (KR)

(73) Assignee: LG Display Co., Ltd., Seoul (KR)

( * ) Notice: Subject to any disclaimer, the term of this patent is extended or adjusted under 35 U.S.C. 154(b) by 66 days.

(21) Appl. No.: 15/378,928

(22) Filed: Dec. 14, 2016

(65) Prior Publication Data

US 2017/0193950 A1 Jul. 6, 2017

(30) Foreign Application Priority Data

Dec. 31, 2015 (KR) ..... 10-2015-0191131

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2300/0809* (2013.01); *G09G 2310/0286* (2013.01); *G09G 2310/0291* (2013.01); *G09G 2310/08* (2013.01); *G09G 2320/045* (2013.01)

(58) Field of Classification Search
CPC ..... G09G 3/3677; G09G 2310/0286
See application file for complete search history.

(56) References Cited

U.S. PATENT DOCUMENTS

2014/0321599 A1* 10/2014 Cho ..... G11C 19/28 377/64
2015/0185522 A1 7/2015 Xu

FOREIGN PATENT DOCUMENTS

| | | |
|---|---|---|
| CN | 202443728 | 9/2012 |
| CN | 103474040 | 12/2013 |
| CN | 104134416 | 11/2014 |
| CN | 104217689 | 12/2014 |
| CN | 104380368 | 2/2015 |
| CN | 104575379 | 4/2015 |
| CN | 104700789 | 6/2015 |
| WO | 2011/148658 A1 | 12/2011 |

OTHER PUBLICATIONS

English language translation of Japanese Office Action included in the IDS dated Jan. 31, 2018.*
Office Action dated Oct. 17, 2017 issued in corresponding Japanese application 2016-252158.
Office Action dated Dec. 14, 2018 with English translation issued in the corresponding Chinese Patent Application No. 201611247340.X, pp. 1-17.

* cited by examiner

*Primary Examiner* — Laurence J Lee
(74) *Attorney, Agent, or Firm* — Polsinelli PC

(57) ABSTRACT

In a gate driver, a Q node is shared by two channels to output a scan signal at high level, and a QB node is shared by four channels to output a scan signal at low level. Accordingly, the number of thin-film transistors required to configure four channels of a gate-in-panel (GIP) is reduced, such that the bezel size can be reduced. Further, the gate driver includes a compensation capacitor or a discharge transistor disposed in some of the channels sharing the Q node, such that deviation in output characteristics among the channels sharing the Q node can be reduced.

20 Claims, 16 Drawing Sheets

Background Art

Background Art

Background Art

FIG. 13

| Measurement | | Another Aspect | | | | Above-Described Aspect | | | |
|---|---|---|---|---|---|---|---|---|---|
| Vout | Rising Time [us] | 3.81 (Vout1) | 2.84 (Vout2) | 3.88 (Vout3) | 2.83 (Vout4) | 4.56 (Vout1) | 3.52 (Vout2) | 4.48 (Vout3) | 3.40 (Vout4) |
| | Falling Time [us] | 1.16 (Vout1) | 1.57 (Vout2) | 1.19 (Vout3) | 1.58 (Vout4) | 1.50 (Vout1) | 2.10 (Vout2) | 1.59 (Vout3) | 2.09 (Vout4) |
| | Falling Time Deviation [us] | 0.41 (Vout1 vs Vout2) | | 0.39 (Vout3 vs Vout4) | | 0.60 (Vout1 vs Vout2) | | 0.50 (Vout3 vs Vout4) | |
| | Voltage [V] | 30.5 | | | | 28.8 | | | |
| Q Node | Pre charging Voltage [V] | 25.6 | | | | 21.6 | | | |
| | Peak Voltage [V] | 44.4 | | | | 39.4 | | | |
| | Bootstrapping Voltage [V] | 18.8 | | | | 17.8 | | | |

GATE DRIVER WITH REDUCED NUMBER OF THIN FILM TRANSISTORS AND DISPLAY DEVICE INCLUDING THE SAME

CROSS-REFERENCE TO RELATED APPLICATIONS

This application claims the priority of Korean Patent Application No. 10-2015-0191131 filed in the Republic of Korea on Dec. 31, 2015, which is hereby incorporated by reference in its entirety.

BACKGROUND

Field of the Disclosure

The present disclosure relates to a display device, and more particularly to a gate driver and a display device including the same. Although the present disclosure is suitable for a wide scope of applications, it is particularly suitable for a gate driver with a reduced bezel size by reducing the number of thin-film transistors.

Description of the Background

As a variety of portable electronic devices such as mobile terminals and laptop computers have been developed, demands toward flat panel display devices employed by such devices are increasing.

Research is ongoing into the flat panel display devices, including liquid-crystal display (LCD) devices, plasma display panel (PDP) devices, field emission display (FED) devices, and organic light-emitting diode display (OLED) devices.

Among these flat panel display devices, an LCD device finds more applications since it can be produced in large quantity, can be driven easily, and can achieve high image quality and a large screen.

FIG. 1 is a view showing a display device in the background art.

Referring to FIG. 1, an LCD device display images by adjusting transmittance in each of pixels depending on an input image signal. To this end, the display device includes a display panel 10 in which liquid-crystal cells are arranged in a matrix form, a backlight unit (not shown) for supplying light to the display panel 10, and a driving circuitry for driving the display panel 10 and the backlight unit.

The display panel 10 further includes an active area 20 where images are displayed, and a pad area 30 where no image is displayed and a gate driver 60 and a data pad 40 are formed.

The driving circuitry includes a timing controller, a data driver 50 and the gate driver 60. The data pad 40 is disposed on the upper end or the lower end of the pad area 30. The data driver 50 may be disposed on a printed circuit board (PCB) or a chip-on-film (COF) and may be connected to the data pad 40 via a flexible printed circuit (FPC).

The gate driver 60 sequentially applies scan signals (i.e., gate driving signals) for turning on thin-film transistors formed in the pixels to a plurality of gate lines, respectively. By doing so, the pixels in the display panel 10 are driven sequentially.

To this end, the gate driver 60 includes a shift resister, and a level shift that converts an output signal from the shift register into a signal having a swing width appropriate for driving the thin-film transistors.

A gate-in-panel (GIP) structure is employed, in which thin-film transistors TFT are formed on a lower substrate (array substrate) of the display panel 10 using amorphous silicon a-Si, and the gate driver 60 is integrated with the display panel (i.e., the gate driver 60 is disposed in the display panel). The GIP type gate driver 60 may be disposed on either side of the pad area of the array substrate.

FIG. 2 is a diagram showing four channels of a GIP in the background art. FIG. 3 is a diagram showing a GIP circuit of a display device in the background art.

Referring to FIGS. 2 and 3, the GIP type gate driver 60 in the background art includes a plurality of stages to generate scan signals to apply to the gate lines, respectively. Each of the plurality of stages becomes a channel of the gate driver.

The GIP type gate driver 60 applies scan signals to the gate lines via a plurality of channels. Among all of the channels of the gate driver 60, every two channels share a QB-node, and each of the channels has a Q-node. To apply a scan signal to a gate line, each of the channels of the gate driver 60 includes seventeen transistors TR.

The gate driver circuit repeats a precharging operation of applying voltage at high level to a Q node upon receiving an input signal VST, a charging operation in which the output from the gate driver is changed from low to high level, a discharging operation in which the output is changed from high to low level, and a holding interval in which the output remains at low level. In doing so, the output of each of the channels is precharged and output by the respective Q node.

A transistor T1 of the first channel and another transistor T1 of the second channel are reset transistors, which are reset upon receiving a reset signal. A transistor T2 of the first channel and another transistor T2 of the second channel receive outputs from different stages as a signal VST1 and are turned on at different timings. A transistor T15 is a pull-up transistor, which is turned on upon receiving an output from the transistor T1 to output voltage VSS, or is turned on and by bootstrapping with an output from the transistor T2 and a clock signal CLK to output an output voltage Vout, i.e., a scan signal.

In the gate driver 60 shown in FIGS. 2 and 4, the Q node is divided into Q1 and Q2 such that they are operated separately, and two channels share a QB node such that discharging of the Q node and the holding of the output voltage are controlled.

In the GIP circuit in the background art, seventeen transistors are required to obtain output from a stage, and sixty-eight transistors are required to obtain output from four stages.

For full-HD resolution with 1,920 channels, 32,640 transistors are required for a GIP circuit, which is calculated by multiplying the number of transistors per stage, 17 by the number of the entire channels, 1,920. As a result, the size of the GIP formed in the pad area, which is the inactive area, is increased. For U-HD resolution, the number of transistors in the GIP circuit is doubled, and accordingly the size of the GIP formed in the pad area is further increased.

The size of the bezel surrounding the inactive area is determined depending on the size of the GIP, and thus the size of the bezel increases with the size of the GIP. As a result, the aesthetic design of the display device deteriorates.

In addition, in the background art, the size of the bezel is large, such that the number of panels that can be fabricated from a mother substrate at a time is reduced.

SUMMARY

Accordingly, the present disclosure is directed to a gate driver and a display device including the same that substantially obviate one or more of problems due to limitations and disadvantages in the described above.

It is an object of the present disclosure to provide a gate driver capable of reducing the number of thin-film transistor required to configure a plurality of channel in a GIP type gate driver, and a display device including the same.

It is another object of the present disclosure to provide a gate driver capable of reducing the size of a GIP type gate driver, and a display device including the same.

It is yet another object of the present disclosure to provide a gate driver applicable to UHD/FHD display device, and a display device including the same.

It is another object of the present disclosure to provide a gate driver capable of implementing a narrow bezel, and a display device including the same.

It is another object of the present disclosure to provide a display device with improved aesthetic design.

It is another object of the present disclosure to provide a gate driver capable of reducing deviation in output characteristics of a plurality of channels in a GIP type gate driver, and a display device including the same.

Objects of the present disclosure are not limited to the above-mentioned object. Other objects and advantages may be described below or may be obvious to those skilled in the art from the following description from the description.

In accordance with one aspect of the present disclosure, a GIP type data driver includes a plurality of channels that sequentially supplies gate driving signals to a plurality of gate lines formed in the display panel. A Q node is shared by two channels to output a scan signal at high level, and a QB node is shared by four channels to output a scan signal at low level.

Ten transistors may be formed per channel.

Each of the first channel and the second channel sharing the Q node may include a first pull-up transistor outputting a first output voltage according to a first clock signal CLK1 to a first gate line as a data driving signal at high level, and a second pull-up transistor outputting a second output voltage according to a second clock signal CLK2 to a second gate line as a gate driving signal at high level.

In this manner, by forming the first pull-up transistor in the first channel and the second pull-up transistor in the second channel separately, and by using the first clock signal CLK1 and the second clock signal CLK2, the gate driving signals can be output sequentially from the first and second channels.

Between the first and second channels sharing the Q node, when the first channel outputs a gate driving signal at high level, the second channel may output a gate driving signal at low level.

The Q node of the gate driver may include an odd QB node and an even QB node. In the first to fourth channels sharing the QB node, the odd QB node and the even QB node may be alternately driven.

The first to fourth channels sharing the QB node may include an odd pull-down transistor that is turned on by a signal from the odd QB node to output a ground voltage, and an even pull-down transistor that is turned on by a signal from the even QB node to output a ground voltage.

In accordance with one aspect of the present disclosure, a gate-in-panel (GIP) type gate driver includes: $n^{th}$ to $(n+3)^{th}$ channels configured to sequentially apply scan signals to a plurality of gate lines disposed in a display panel, wherein: n is a natural number, a Q1 node is shared by the $n^{th}$ and the $(n+1)^{th}$ channels, and a Q2 node is shared by the $(n+2)^{th}$ and the $(n+3)^{th}$ channels, to output a scan signal at high level; a QB node is shared by the $n^{th}$ to $(n+3)^{th}$ channels to output a scan signal at low level; and the $(n+1)^{th}$ channel comprises a compensation unit. By virtue of the compensation unit disposed in the $(n+1)^{th}$ channel, falling times of the output voltages from the $n^{th}$ channel and the $(n+1)^{th}$ channel becomes closer, such that deviation in output voltages therefrom is reduced.

In accordance with one aspect of the present disclosure, a gate-in-panel (GIP) type gate driver includes: $n^{th}$ to $(n+3)^{th}$ channels configured to sequentially apply scan signals to a plurality of gate lines disposed in a display panel, wherein: n is a natural number, a Q1 node is shared by the $n^{th}$ and the $(n+1)^{th}$ channels, and a Q2 node is shared by the $(n+2)^{th}$ and the $(n+3)^{th}$ channels, to output a scan signal at high level; a QB node is shared by the $n^{th}$ to $(n+3)^{th}$ channels to output a scan signal at low level; and the $(n+1)^{th}$ channel comprises a discharge unit. By virtue of the discharge unit disposed in the $(n+1)^{th}$ channel, falling times of the output voltages from the $n^{th}$ channel and the $(n+1)^{th}$ channel becomes closer, such that deviation in output voltage therefrom is reduced.

According to an aspect of the present disclosure, the size of a GIP can be reduced by reducing the number of thin-film transistors TFT required to configure a plurality of channels of the GIP.

According to an aspect of the present disclosure, a narrow bezel can be implemented by reducing the number of thin-film transistors TFT formed in the GIP.

According to an aspect of the present disclosure, there is provided a GIP type gate driver applicable to UHD/FHD display devices.

According to an aspect of the present disclosure, the aesthetic design of a display device can be improved.

In addition, according to an aspect of the present disclosure, in a GIP type gate driver, the deviation in the output characteristics of a plurality of channels can be reduced.

Objects of the present disclosure are not limited to the above-mentioned objects. Other objects and advantages may be obvious to those skilled in the art from the following descriptions. It is to be understood that both the foregoing general description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings:

FIG. 13 is a table showing output characteristics of first to fourth channels according to another aspect of the present disclosure;

DETAILED DESCRIPTION

Figure 1:
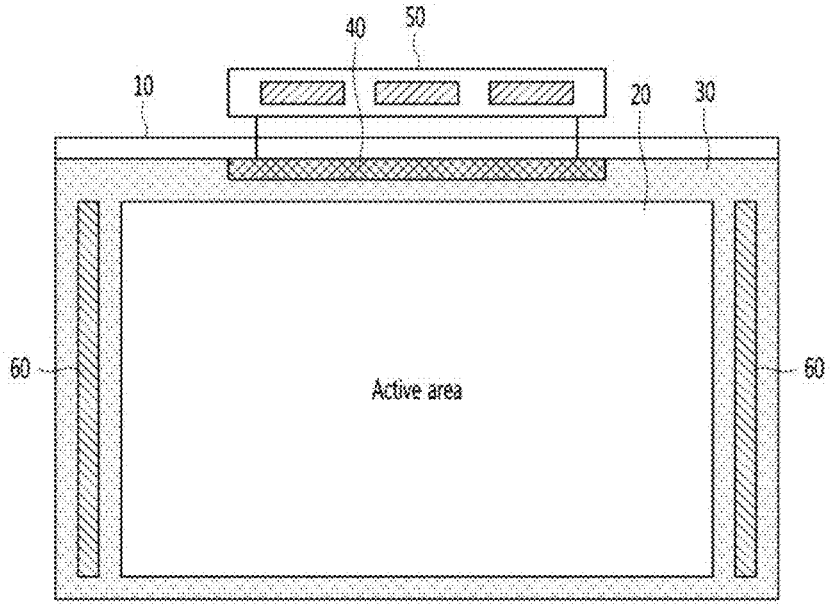
FIG. 1 is a view showing a display device in the background art.
Figure 2:
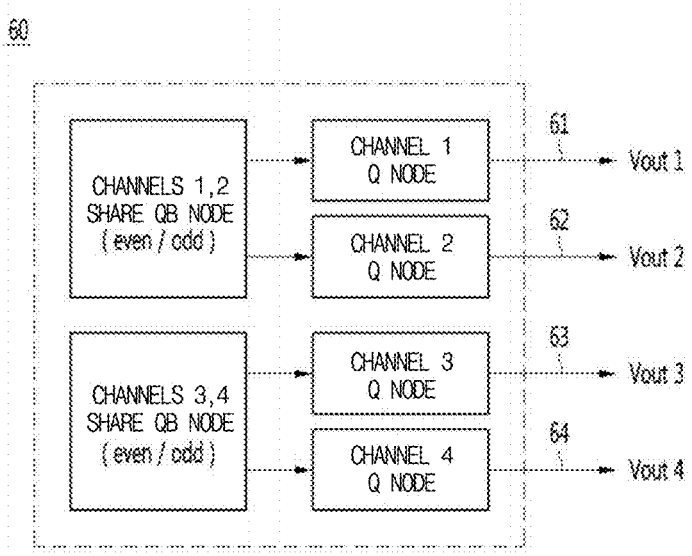
FIG. 2 is a diagram showing four channels of a GIP in the background art.
Figure 3:
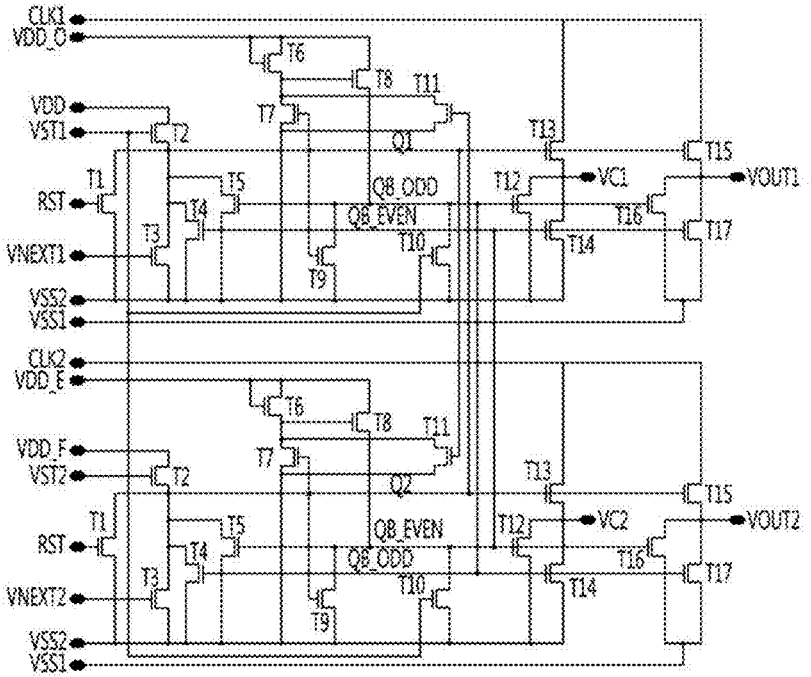
FIG. 3 is a diagram showing a GIP circuit of a display device in the background art.

In the following description, embodiments are described in sufficient detail to enable those skilled in the art to practice the present disclosure. Therefore, it should be noted that the spirit of the present disclosure is not limited to the aspects set forth herein and those skilled in the art could easily accomplish other aspects of the present disclosure. Like reference numerals denote like elements throughout the description.

Advantages and features of the present disclosure and methods to achieve them will become apparent from the descriptions of aspects herein below with reference to the accompanying drawings. However, the present disclosure may be modified in many different ways and it should not be limited to aspects set forth herein. These aspects are provided so that this disclosure will be thorough and complete, and will fully convey the scope of the inventive subject matter to those skilled in the art. The disclosure is defined solely by the appended claims. Like reference numerals denote like elements throughout the descriptions. In the drawings, the size of some of the elements may be exaggerated and not drawn on scale for illustrative purposes.

It will be understood that when an element or layer is referred to as being "on" another element or layer, the element or layer can be directly on another element or layer or intervening elements or layers may also be present. In contrast, when an element is referred to as being "directly on" another element, there is no intervening element present.

Spatially relative terms, such as "below," "beneath," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the term "below" can encompass both orientations of above and below.

Terms used in the present specification are for illustrating the aspects rather than limiting the present disclosure. Unless specifically mentioned otherwise, a singular form includes a plural form in the present specification. Throughout this specification, the word "comprise" and variations such as "comprises" or "comprising," will be understood to imply the inclusion of stated constituents, steps, operations and/or elements but not the exclusion of any other constituents, steps, operations and/or elements.

In the following description with reference to the drawings, a gate driver according to an aspect of the present disclosure is applied to an LCD device.

LCD devices can be operated in a variety of modes such as a twisted nematic (TN) mode, a vertical alignment (VA) mode, an in-plane switching (IPS) mode, a fringe field switching (FFS) mode, depending on the way of aligning a liquid-crystal layer.

The display device according to aspect the present disclosure is not particularly limited by the modes, and the technical idea of the present disclosure is equally applicable to the modes.

Hereinafter, a gate driver of a display panel according to an aspect of the present disclosure will be described in detail with reference to the accompanying drawings.

Figure 4:
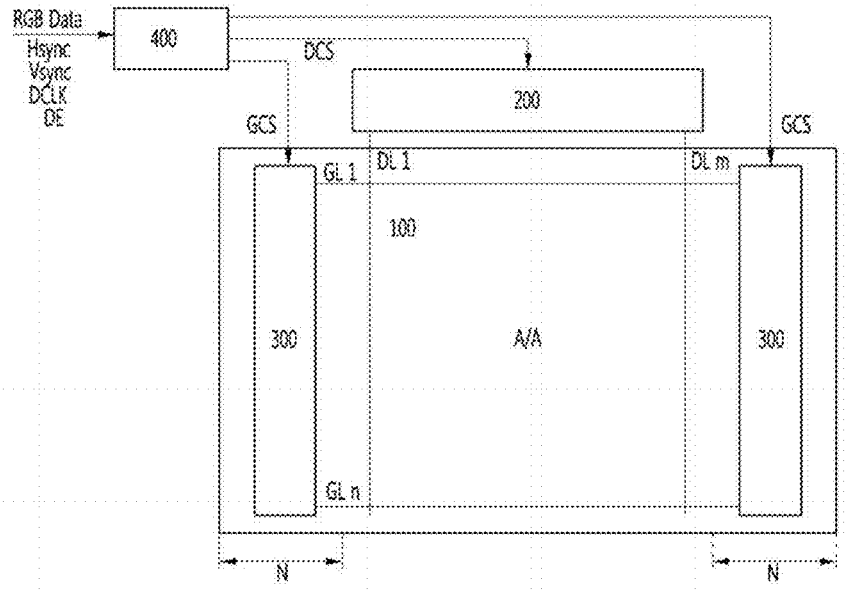
FIG. 4 is a diagram schematically showing a display device according to an aspect of the present disclosure.

FIG. 4 is a diagram schematically showing a display device according to an aspect of the present disclosure.

The display device includes a display panel 100 in which pixels are arranged in a matrix form, a backlight unit (not shown) for supplying light to the display panel 100, and a driving circuitry for driving the display panel 100 and the backlight unit.

The display panel 100 includes an active area A/A where images are displayed, and an inactive area N including gate drivers 300. The display panel 100 includes gate lines GL1 to GLn, and data lines DL1 to DLm which intersect each other and are arranged in a matrix form. Pixels are defined at each of the intersections. In each of the pixels, a thin-film transistor TFT, a liquid-crystal capacitor Clc and a storage capacitor Cst are disposed. All of the pixels form at the active area A/A.

The driving circuitry includes a timing controller 400, a data driver 200, and a gate driver 300. The display panel 100 may display images. The timing controller 400 receives a timing signal from an external system to generate a variety of control signals. The data driver 200 and the gate driver 300 may control the display panel 100 in response to the control signals.

The timing controller 400 receives an image signal RGB transmitted from an external system, and timing signals such as a clock signal DCLK, a horizontal synchronization signal Hsync, a vertical synchronization signal Vsync and a data enable signal DE, and generates a control signal for the data driver 200 and the gate driver 300.

The horizontal synchronization signal Hsync indicates a time taken to display a horizontal line on the screen. The vertical synchronization signal Vsync indicates a time taken to display a screen order per frame. The data enable signal DE indicates a period of time in which a data voltage is applied to the pixels defined in the display panel 100.

The timing controller 400 is connected to an external system via a predetermined interface, and receives signals associated with images and timing signals output therefrom at high speed without noise. Such a predetermined interface includes a low voltage differential signal (LVDS) scheme or a transistor-transistor logic (TTL) interface scheme, etc.

In addition, the timing controller 400 generates a control signal DCS for the data driver 200 and a control signal GCS for the gate driver 300 in synchronization with input timing signals.

The timing controller 400 further generates a plurality of clock signals to determine driving timings of each of stages of the gate driver 300 and provides the clock signals to the gate driver 300. Also, the timing controller 400 coordinates and modifies the received image data RGB DATA so that it is processable by the data driver 200, and outputs it. A color coordinate correction algorithm for improving image quality may be applied to the coordinated image data. The control signal GCS for the gate driver 300 includes a gate start pulse, a gate shift clock, a gate output enable, etc.

The data driver 200 may be formed on a printed circuit board (PCB) or a chip-on-film (COF) and may be connected to a pad (not shown) disposed on the display panel 100 via a flexible printed circuit (FPC). The data driver 200 shifts a source start pulse (SSP) from the timing controller 400 according to a source shift clock (SSC) to thereby generate sampling signals. In addition, the data driver 200 latches image data input by the SSC according to a sampling signal, thereby changing to a data signal. Then, the data driver 200 applies data signals to data lines DL horizontal line by horizontal line in response to a source output enable (SOE) signal. To this end, the data driver 200 may include a data sampling unit, a latch unit, a D/A conversion unit, and an output buffer.

Then, the gate driver 300 includes a plurality of stages including a shift register. In addition, the gate driver 300 may include a level shift that converts an output signal from the shift register into a signal having a swing width appropriate for driving thin-film transistors. The gate driver 300 may output a gate high voltage VGH that is a scan pulse alternately via the plurality of gate lines GL1 to GLn formed on the display panel 100 in response to the gate control signal GCS input from the timing controller 400. The output gate high voltage VGH may overlap for a certain horizontal duration. This is to precharge the gate lines GL1 to GLn. By virtue of the precharging operation, the pixels can be more stably charged when a data voltage is applied. During the rest of the period of time in which no scan pulse of the gate high voltage VGH is applied, a gate low voltage VGL is applied to the gate lines GL1 to GLn. The gate low voltage VGL may be provided from a first ground voltage VSS1 and a second ground voltage VSS2. The first ground voltage VSS1 is a voltage of low level for stably operating the gate terminal of a TFT disposed in a pixel. The second ground voltage VSS2 is a voltage of low level even lower than the first ground voltage VSS1, for operating the discharge operation of a Q node or a QB node of a gate driver circuit.

The gate driver 300 employed by the aspect of the present disclosure may be formed independently of the panel and electrically connected to the panel in a variety of ways. In addition, when an array substrate of the display panel 100 is fabricated, the gate driver 300 may be disposed on one or both sides in the inactive area N as a thin film pattern in a GIP structure. In this case, a gate control signal GCS for controlling the gate driver 300 may be a clock signal CLK and a gate start pulse VST for driving the firstly driven stage of the shift register. In the following description, the "gate driver 300" is referred to as a "GIP 300"

The aspects of the present disclosure can reduce the size of the GIP of a display device to thereby reduce the size of the bezel, and reduce deviation in output characteristics of a plurality of stages. Accordingly, the driving circuitry and the backlight unit for supplying light to the display panel, except for the GIP circuit, may not be illustrated nor depicted in the drawings.

Figure 5:
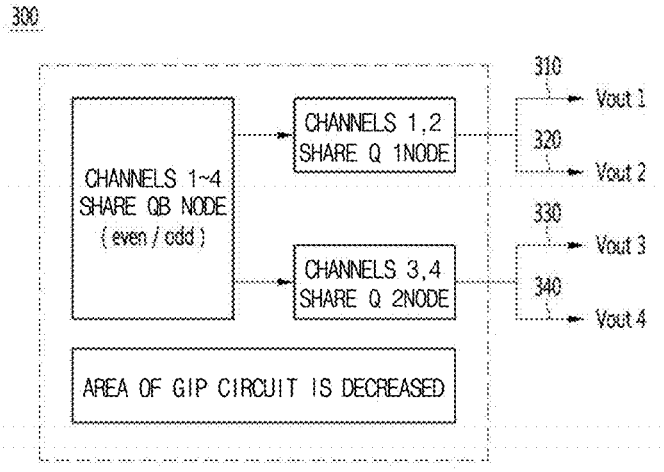
FIG. 5 is a diagram showing four channels of a GIP according to an aspect of the present disclosure.
Figure 6:
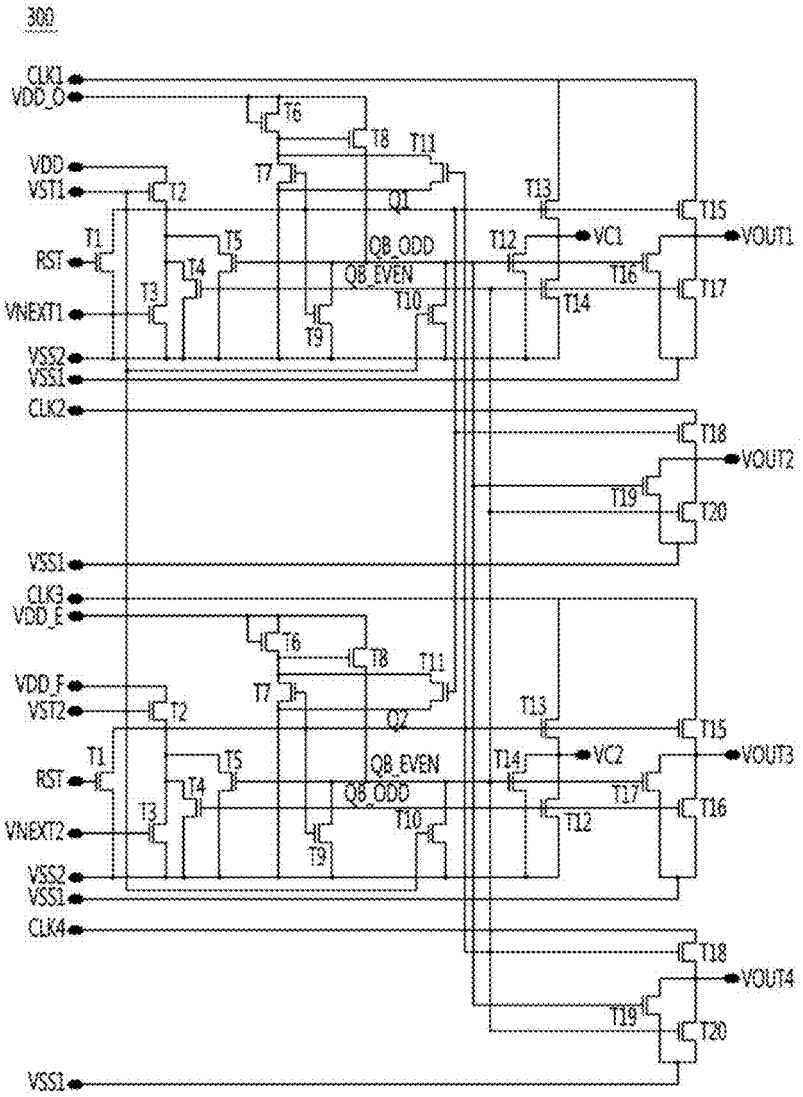
FIG. 6 is a diagram showing a GIP circuit of a display device according to aspects of the present disclosure.

FIG. 5 is a diagram showing four channels of a GIP according to an aspect of the present disclosure. FIG. 6 is a diagram showing a GIP circuit of a display device according to aspects of the present disclosure.

FIGS. 5 and 6 show four channels among the entire channels of the GIP.

Referring to FIG. 5, the GIP 300 of the display device according to the aspect of the present disclosure generates a scan signal and applies scan signals to gate lines via channels. To this end, the GIP 300 includes a plurality of stages for applying scan signals to the channels. The output from each of the plurality of stages becomes one channel of the gate, such that a scan signal is applied to a gate line.

In the GIP 300 according to the aspect of the present disclosure, the number of transistors of a shift register can be reduced while the design area of a gate driver can be drastically decreased.

Referring to FIG. 6, according to the aspect of the present disclosure, the number of transistors per channel is decreased to ten, such that the four channels can be formed with forty transistors. In the existing GIP circuit, seventeen transistors are required per channel. In contrast, according to the present disclosure, the number of transistors per channel is decreased to ten, thereby decreasing the GIP design area.

A Q node for driving pull-up transistors TR15 and TR18 is formed in each of the stages of the GIP 300, and a QB node for driving pull-down transistors TR16, TR17, TR19 and TR20 is included.

In FIG. 6, a QB node is provided for four channels, that is, a QB node is shared by four channels. In addition, in the shown GIP circuit, a Q node is provided for two channels, that is, a Q node is shared by two channels. As such, a Q node and a QB node are shared by the four channels, such that gate driving signals may be output sequentially. By doing so, the design area of the GIP can be decreased.

A transistor T15 of the first channel and a transistor T18 of the second channel are pull-up transistors. Likewise, a transistor T15 of the third channel and a transistor T18 of the fourth channel are pull-up transistors.

In addition, to prevent deterioration of the pull-down transistors, the QB nodes of the channels may be divided into odd nodes and even nodes to be driven. The number of the QB nodes is not particularly limited by the aspects of the present disclosure.

The first channel and the second channel share the same Q node, and when the pull-up transistor T15 of the first channel is turned on such that a gate driving signal at high level is output from the first channel, the pull-up transistor T18 of the second channel is turned off such that a gate driving signal at low level is output from the second channel.

Likewise, the third channel and the fourth channel share the same Q node, and when the pull-up transistor T15 of the third channel is turned on such that a gate driving signal at high level is output from the third channel, the pull-up transistor T18 of the fourth channel is turned off such that a gate driving signal at low level is output from the fourth channel.

A transistor T16 of the first channel and a transistor T19 of the second channel are odd pull-down transistors. Likewise, a transistor T16 of the third channel and a transistor T19 of the fourth channel are odd pull-down transistors. A transistor T17 of the first channel and a transistor T20 of the second channel are even pull-down transistors. Likewise, a transistor T17 of the third channel and a transistor T20 of the fourth channel are even pull-down transistors.

The first to fourth channels share the same QB node (odd/even QB node). An odd QB node and an even QB node of the channels are alternately driven, and the first to fourth channels share an odd QB node and a QB node.

The transistor T1 is commonly formed in the first channel and the second channel is a reset transistor, and the first channel and the second channel are reset when a reset signal is input. Likewise, the transistor T1 is commonly formed in the third channel and the fourth channel is a reset transistor, and the third channel and the fourth channel are reset when a reset signal is input.

The transistors T2 and T3 applying the supply voltage to the first channel and the second channel are formed in series between the supply voltage VDD and the second ground voltage VSS2.

As a signal VST1 input to the gate terminal of the transistor T2 of the first channel and the second channel, an output voltage from the $(n-4)^{th}$ channel may be used. As a signal VNEXT input to the gate terminal of the transistor T3, an output voltage VOUT(n+4) from the $(n+4)^{th}$ channel may be used. In addition, as the signal VNEXT, a carry voltage VC(n+4) of the $(n+4)^{th}$ channel may be used.

A signal VST1 is applied to the gate terminal of the transistor T2, and the supply voltage VDD is applied to the source terminal thereof. The output terminal (i.e., the drain terminal) of the transistor T2 is connected to the gate terminal of the pull-up transistor T15 via a Q node.

A signal VNEXT1 is applied to the gate terminal of the transistor T3, and the second ground voltage VSS2 is applied to the source terminal thereof. The output terminal (i.e., the drain terminal) of the transistor T3 is connected to the gate terminal of the pull-up transistor T15 via a Q node.

The supply voltage VDD is applied to the gate terminals of the pull-down transistors T16, T17, T19 and T20 via the QB node.

In the first channel, a first pull-up transistor T15 supplying a first output voltage according to a first clock signal CLK1 to the first channel is formed. In the second channel, a second pull-up transistor T18 supplying a second output voltage according to a second clock signal CLK2 to the second channel is formed.

In the third channel, a first pull-up transistor T15 supplying a third output voltage according to a third clock signal CLK3 to the third channel is formed. In the fourth channel, a second pull-up transistor T18 supplying a fourth output voltage according to a fourth clock signal CLK4 to the fourth channel is formed.

The first pull-up transistor T15 is a pull-up transistor of the first channel for supplying a scan signal to the first gate line. The second pull-up transistor T18 is a pull-up transistor of the second channel for supplying a scan signal to the $(n+1)^{th}$ gate line. The first pull-up transistor T15 and the second pull-up transistor T18 are turned on by the outputs from the transistors T2 and T3.

The output terminal (drain terminal) of the first pull-up transistor T15 is connected to the channel of the $n^{th}$ gate line. The output terminal (drain terminal) of the second pull-up transistor T18 is connected to the channel of the $(n+1)^{th}$ gate line.

The pull-down transistors T16, T17, T19 and T20 for pulling down the first output voltage of the first pull-up transistor T15 to the first ground voltage VSS1 are formed.

The gate terminals of the pull-down transistors T16 and T17 are connected to the odd or even QB node, the source terminal thereof is connected to the output terminal of the first pull-up transistor T15, and the drain terminal thereof is connected to the first ground voltage VSS1.

The gate terminals of the pull-down transistors T19 and T20 are connected to the odd or even QB node, the source terminal thereof is connected to the output terminal of the pull-up transistor T18, and the drain terminal thereof is connected to the first ground voltage VSS1.

The pull-down transistors T16, T17, T19 and T20 are turned on by a VDD odd voltage or a VDD even voltage. The pull-down transistors T16, T17, T19 and T20 pull down scan signals applied to the $n^{th}$ to $(n+3)^{th}$ gate lines.

The transistors T6 to T8 and T11 for applying the VDD odd voltage or the VDD even voltage to the gate terminals of the pull-down transistors T16, T17, T19 and T20 are formed. The VDD odd voltage or the VDD even voltage are alternately applied to the gate terminal and the source terminal of the transistor T6, and the VDD odd voltage or the VDD even voltage are applied to the pull-down transistors T16, T17, T19 and T20 via the transistors T8 and T11.

The driving signal of the pull-down transistors T16, T17, T19 and T20 are applied to the QB node, such that the voltage level of the scan signals applied to the gate lines is pulled down to the first ground voltage VSS1.

The Q node is formed between the output terminal of the transistor T2 and the gate terminals of the first and second transistors T15 and T18. In addition, the third QB node is formed between the gate terminal of the pull-down transistors T16, T17, T18 and T19 and the first ground voltage VSS1, and between the output terminals of the transistors T8 to T10 and the second ground voltage VSS2.

Figure 7:
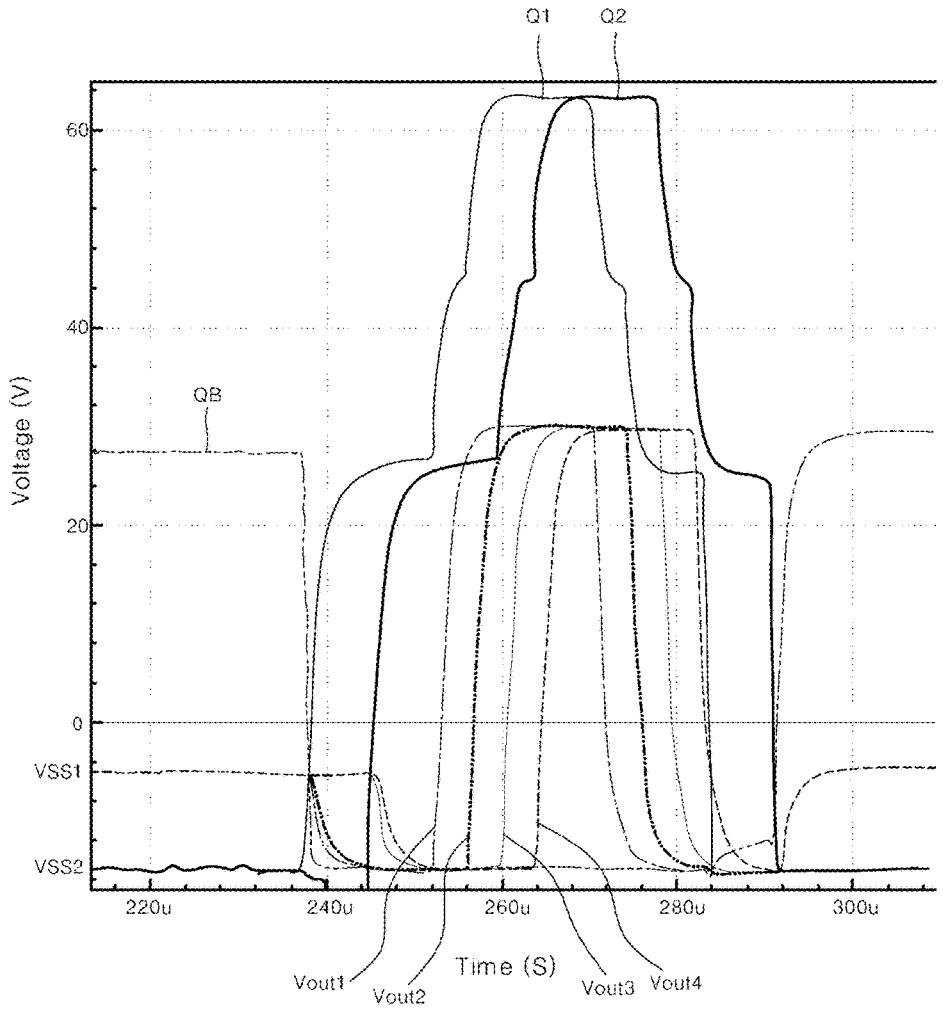
FIG. 7 is a graph showing outputs from a Q1 node, a Q2 node and a QB node of four channels of the GIP according to an aspect of the present disclosure.

FIG. 7 is a graph showing outputs from a Q1 node, a Q2 node and a QB node of four channels of the GIP according to an aspect of the present disclosure.

Referring to FIG. 7, in the GIP 300 of the display device according to the aspect of the present disclosure, four channels share a single QB node, and two channels share a single Q node, such that gate driving signals may be output from the four channels sequentially. Specifically, the Q node may include a Q1 node disposed at channel 1 and a Q3 node disposed at channel 3. The Q1 node is shared by channel 1 and channel 2, and the Q2 node is shared by channel 3 and channel 4. In addition, the gate driving signals output from the four channels may be separated by using the first to fourth clock signals CLK1 to CLK4.

In the GIP 300 according to an aspect of the present disclosure, the Q1 node and the Q2 node are shared, such that bootstrapping occurs twice by two clock signals. As a result, although there is a slight difference in rising time and falling time between the voltage at the $n^{th}$ output terminal VOUT(n) and the voltage at the $(n+1)^{th}$ output terminal VOUT(n+1), it is possible to normally charge and hold the pixel voltage.

Figure 8:
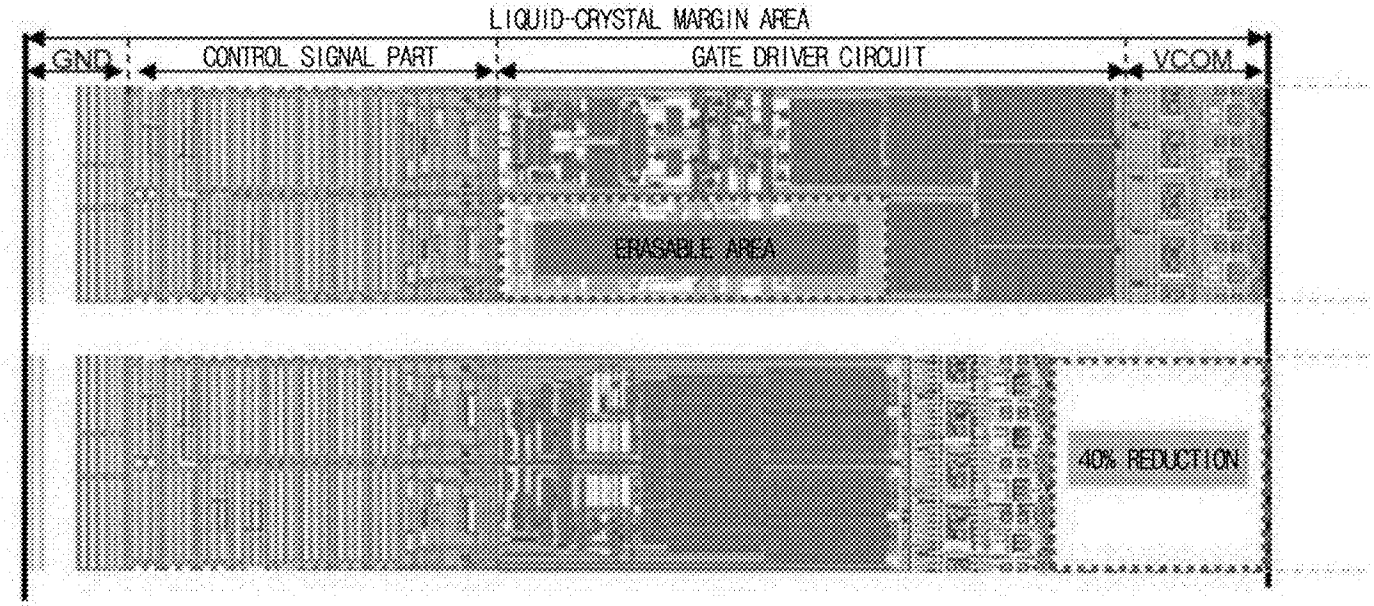
FIG. 8 is a diagram showing reduced size of the bezel by decreasing the area of the gate driver circuit.

FIG. 8 is a diagram showing reduced size of the bezel by decreasing the area of the gate driver circuit.

Referring to FIG. 8, in the existing GIP circuit, seventeen transistors are required to obtain an output of a stage, and sixty-eight transistors are required to obtain outputs from four channels. As a result, the area of the gate driver circuit is increased, and thus there is a problem in that the size of the bezel is increased.

In contrast, in the gate driver of the display device according to an aspect of the present disclosure, since ten transistors are formed per channel, only forty transistors are required to obtain outputs from four channels. Accordingly, the area of the gate driver circuit is decreased by 40% compared to the existing display device, such that the size of the bezel can be reduced.

Figure 9:
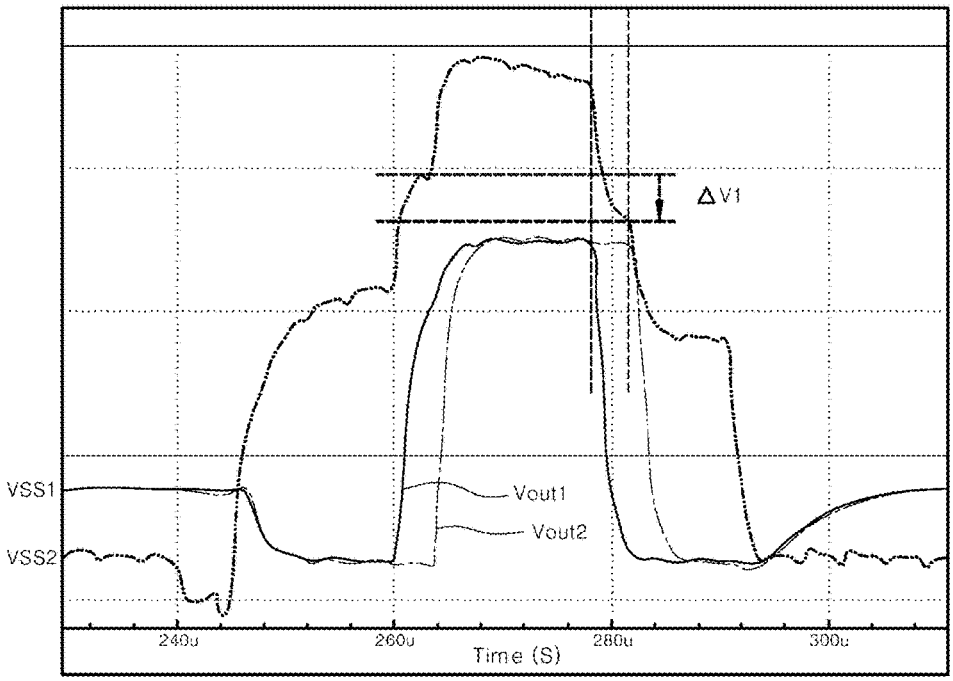
FIG. 9 is a graph showing output characteristics of first and second channels sharing a Q1 node according to an aspect of the present disclosure.

FIG. 9 is a graph showing output characteristics of first and second channels sharing a Q1 node according to an aspect of the present disclosure.

Referring to FIG. 9, in the GIP 300 according to the aspect of the present disclosure, the output voltage VOUT1 of the first channel and the output voltage VOUT2 of the second channel share a single Q1 node, and thus there is a deviation in output characteristics with a slight difference in rising and falling times. According to an aspect of the present disclosure, even if there is a deviation in the output characteristics, it is possible to normally charge and hold the pixel voltage. However, such a deviation in the output characteristics may result in problems such as color mixture of RGB data at a particular pattern or in a display driving environment, or at an edge of the display area, due to an error in charging with the pixel voltage. Such a deviation in the output characteristics occurs in the aspect of the present disclosure since a leakage current Ioff is generated in a transistor that holds the Q1 node while a voltage at high level is applied to the Q1 node. That is, to cause bootstrapping twice and discharge the Q1 node fast, the Q1 node applies the second ground voltage VSS2 that is lower than the first ground voltage VSS1. As a result, a high voltage is applied to the transistor holding the Q1 node, such that a leakage current is generated. Since the above-described problem takes place between the channels sharing the Q node, the first channel and the second channel sharing the Q1 node will be described in detail below. That is, the above-described problem may also take place between the third and fourth channels sharing the Q2 node.

Referring to FIGS. 7 and 9, in the GIP 300 according to the aspect of the present disclosure, the Q1 node compares the voltage before the second bootstrapping with the voltage before the second discharging for applying the gate low voltage to the output voltage VOUT2 of the second channel, such that voltage drop ΔV1 of the Q1 node is generated. The voltage drop ΔV1 of the Q1 node is generated due to the leakage current of the transistor holding the Q1 node. As a result, in the GIP 300 according to the aspect of the present disclosure, the falling time of the output voltage VOUT2 of the second channel is reduced by the voltage drop ΔV1 of the Q1 node, compared to the first channel that is driven fast with the high voltage of the Q1 node.

Figure 10:
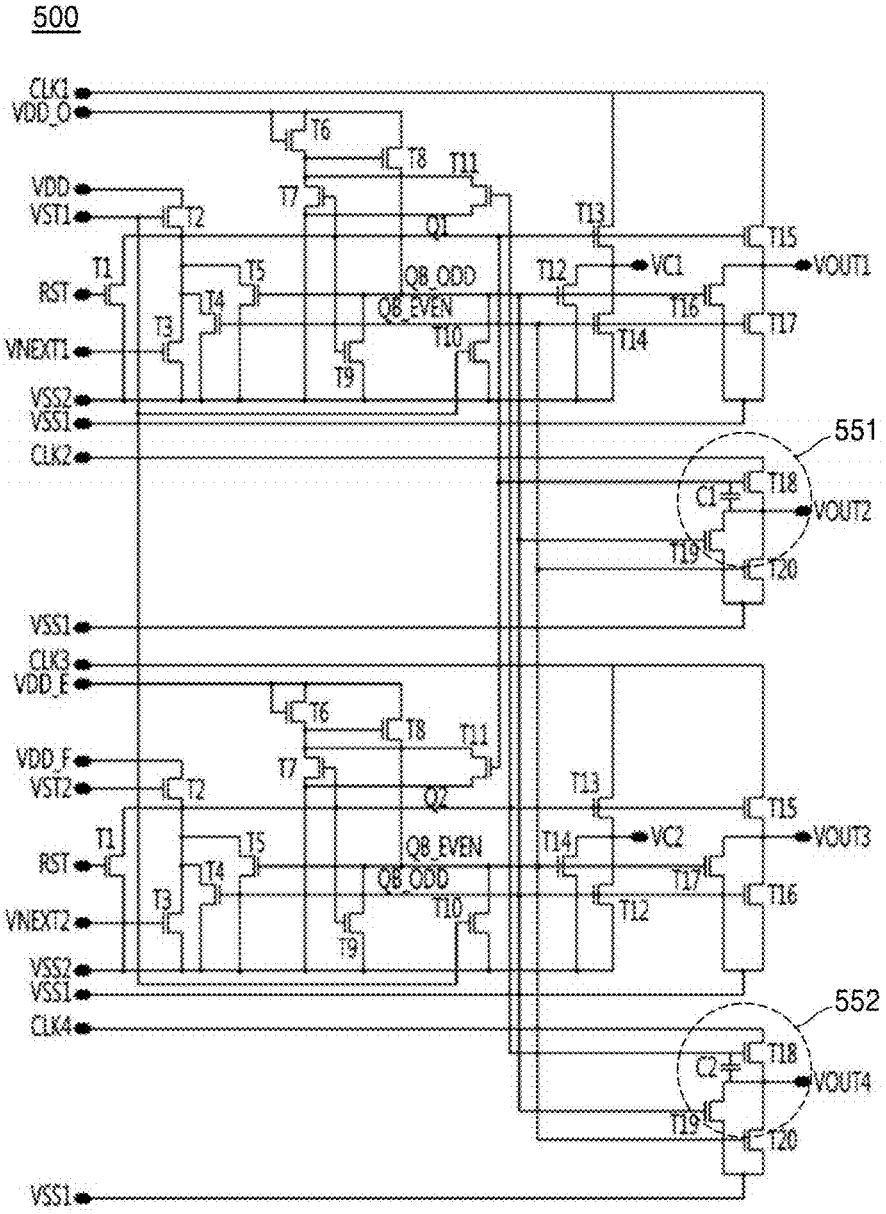
FIG. 10 is a diagram showing a GIP circuit of a display device according to another aspect of the present disclosure.

FIG. 10 is a diagram showing a GIP circuit of a display device according to another aspect of the present disclosure.

Referring to FIG. 10, a GIP 500 according to this aspect improves the deviation in the output characteristics of the GIP 300.

The GIP 500 according to another aspect includes all of the elements of the GIP 300 of FIGS. 4 and 6 according to the above-described aspect. In addition, the GIP 500 of FIG. 10 further includes a compensation unit in the $(n+1)^{th}$ channel of the $n^{th}$ channel and the $(n+1)^{th}$ channel sharing the Q node. In addition, the GIP 500 of another aspect of the present disclosure further includes a compensation unit in the $(n+3)^{th}$ channel of the $(n+2)^{th}$ channel and the $(n+3)^{th}$ channel sharing the Q node. The compensation circuit unit may include compensation capacitors C1 and C2. For example, the GIP 500 may include four channels, and may include a first compensation unit 551 in the second channel of the first and second channels sharing the Q1 node, and a second compensation unit 552 in the fourth channel of the third and fourth channels sharing the Q2 node. Specifically, the first compensation unit 551 may include a first compensation capacitor C1. The first compensation capacitor C1 may be disposed between a transistor T18 and a transistor T19 disposed in the second channel. That is, the first compensation capacitor C1 may be connected to the gate terminal of the transistor T18 and the source terminal of the transistor T19 disposed in the second channel. In addition, the second compensation unit 552 may include a second compensation capacitor C2. The second compensation capacitor C2 may be disposed between a transistor T18 and a transistor T19 disposed in the fourth channel. That is, the second compensation capacitor C2 may be connected to the gate terminal of the transistor T18 and the source terminal of the transistor T19 disposed in the fourth channel. Accordingly, the voltage at the Q1 node of the second channel and the voltage at the Q2 node of the fourth channel may be stepped up by the first and second compensation units 551 and 552. As a result, in the GIP 500 of FIG. 10, the falling times of the output voltages VOUT2 and VOUT4 of the second and fourth channels become close to the falling times of the output voltages VOUT1 and VOUT3 of the first and third channels, and thus the deviation in the output can be reduced.

Figure 11:
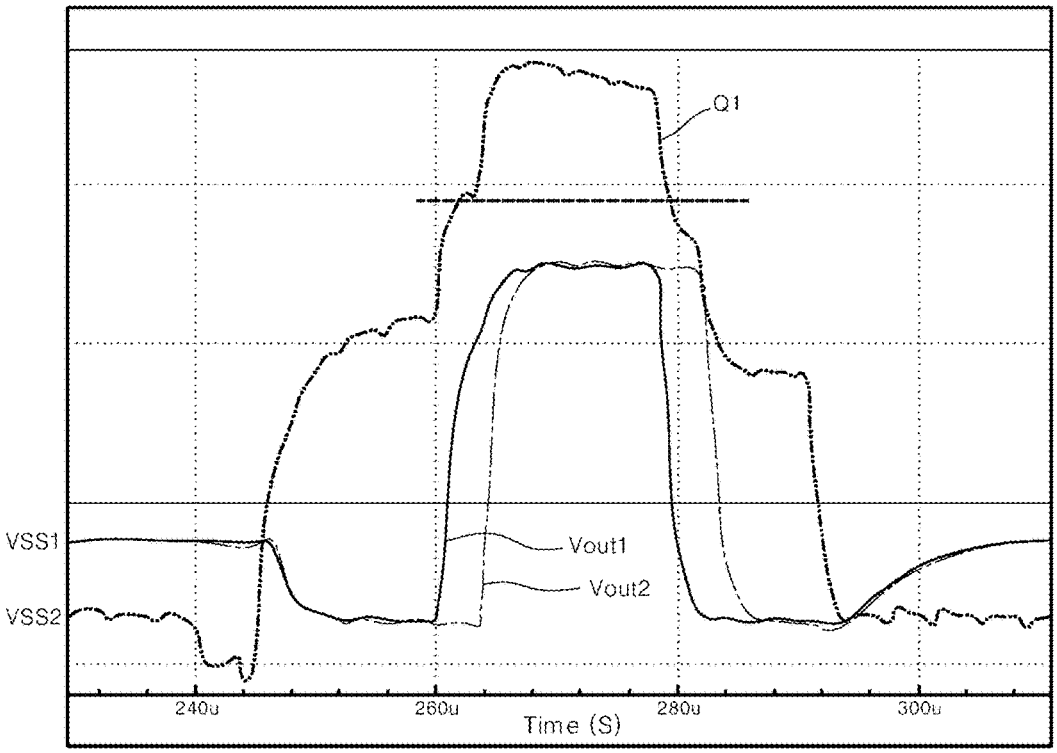
FIG. 11 is a graph showing output characteristics of first and second channels sharing a Q1 node according to another aspect of the present disclosure.
Figure 12:
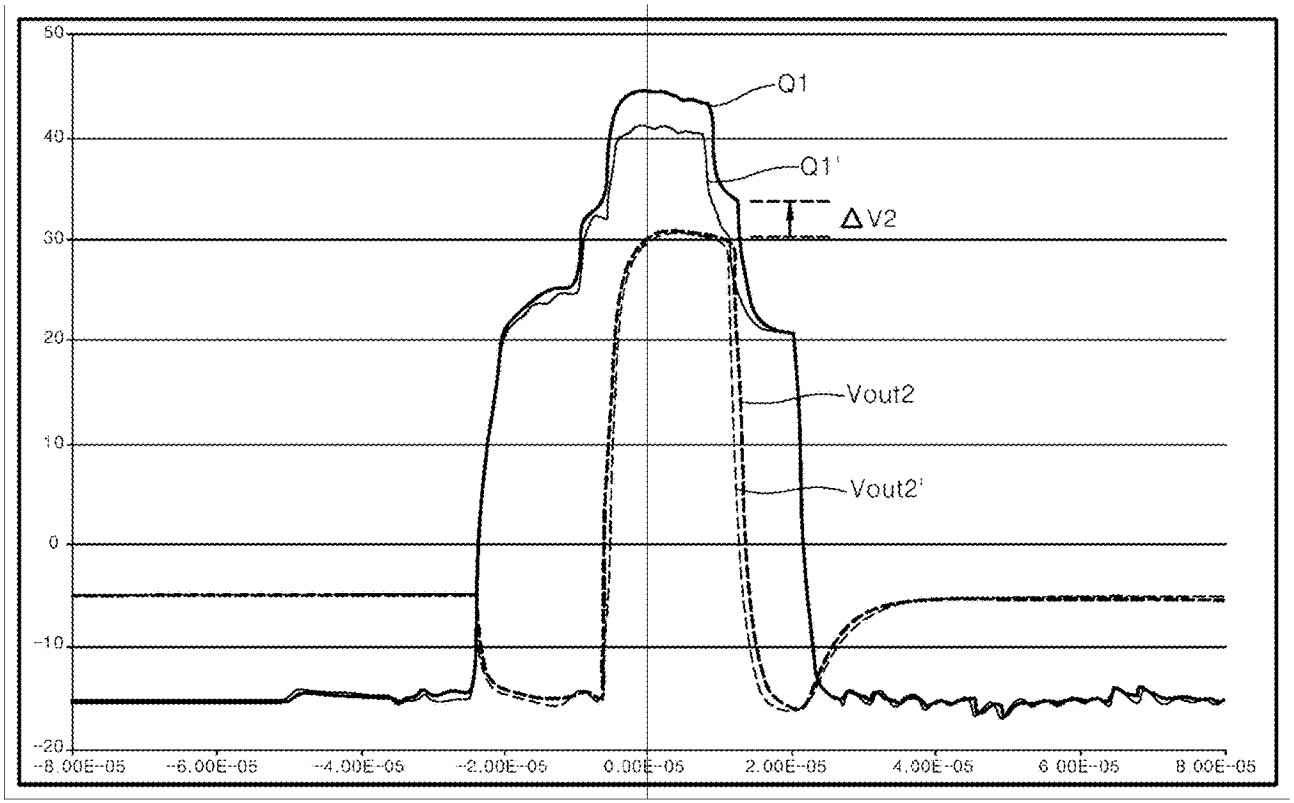
FIG. 12 is a graph showing output characteristics of the second channel of the first and second channels sharing a Q1 node according to another aspect of the present disclosure.

FIG. 11 is a graph showing output characteristics of first and second channels sharing a Q1 node according to another aspect of the present disclosure. FIG. 12 is a graph showing output characteristics of the second channel of the first and second channels sharing a Q1 node according to another aspect of the present disclosure. FIG. 13 is a table showing output characteristics of first to fourth channels according to another aspect of the present disclosure.

As shown in FIG. 11, the voltage drop ΔV1 at the Q1 node is reduced compared to the graph shown in FIG. 9. As shown in FIG. 12, the voltage at the Q1 node according to the aspect is increased by the voltage ΔV2 compared to the voltage at the Q1' node. The voltage at the Q1 node is increased since the voltage is compensated for by the first compensation capacitor C1 of the first compensation unit 551.

Referring to FIG. 13, the table compares the output voltage characteristics of the first to fourth channels and the voltage characteristics of the Q node of the above-described aspect with those of another aspect of the present disclosure. More specifically, in the GIP 300 of FIG. 6, the deviation in the falling time between the output voltage VOUT1' of the first channel and the output voltage VOUT2' of the second channel is 0.60 μs. On the other hand, in the GIP 500 of FIG. 10, the deviation in the falling time between the output voltage VOUT1 of the first channel and the output voltage VOUT2 of the second channel is 0.41 μs. In addition, in the GIP 300 of FIG. 6, the deviation in falling time between the output voltage VOUT3' of the third channel and the output voltage VOUT4' of the fourth channel is 0.50 μs. On the other hand, in the GIP 500 of FIG. 10, the deviation in the falling time between the output voltage VOUT3 of the third channel and the output voltage VOUT4 of the fourth channel is 0.39 μs. That is, the deviation in outputs between the channels of the GIP 500 was reduced compared to the GIP 300.

Accordingly, the GIP 500 of FIG. 10 can be driven faster by increasing the voltages at the Q1 node and the Q2 node by the first and second compensation units 551 and 552, such that the falling times of the output voltages VOUT2 and VOUT4 of the second and fourth channels are reduced. That is, in the GIP 500 of FIG. 10, the falling times of the output voltages VOUT1 and VOUT2 of the first and second channels become closer, such that the deviation in output between the output voltages VOUT1 and VOUT2 of the first and second channels can be reduced.

Figure 14:
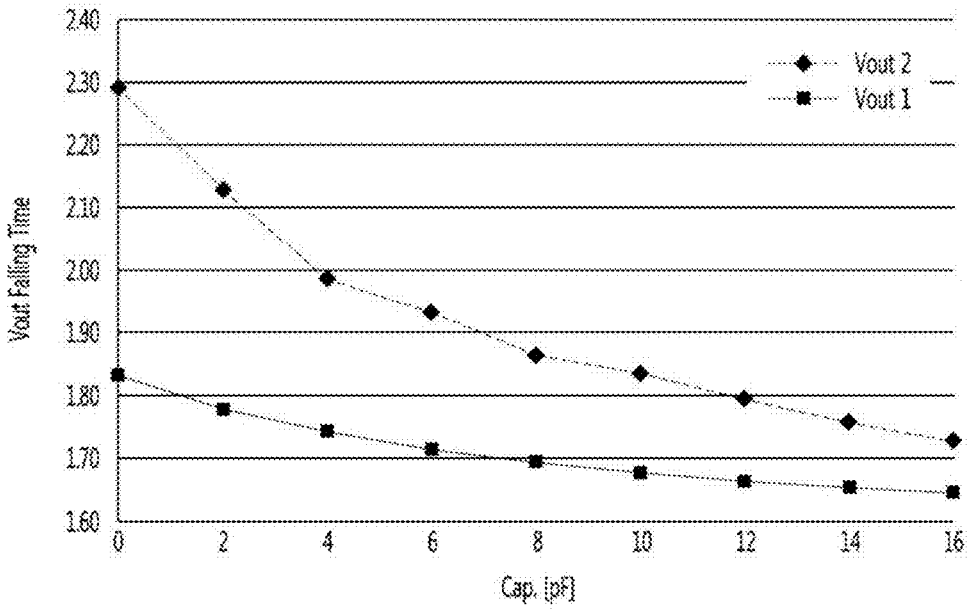
FIG. 14 is a graph showing deviation in output between the first and second channels sharing the Q1 node according to another aspect of the present disclosure is improved by the compensation capacitors.

FIG. 14 is a graph showing a deviation in output between the first and second channels sharing the Q1 node according to another aspect of the present disclosure is improved by the compensation capacitors.

Referring to FIG. 14, in the GIP 500 of FIG. 10, the falling time of the output from the $(n+1)^{th}$ channel is reduced as the capacity of the compensation capacitor of the compensation unit is increased, such that the falling time of the $n^{th}$ channel becomes closer to the falling time of the $(n+1)^{th}$ channel. For example, where the first and second channels share a Q1 node, the falling time of the output voltage of the first channel becomes closer to that of the second channel as the capacity of the first compensation capacitor C1 of the first compensation unit 551 is increased, such that the deviation in output between the two channels can be reduced.

Figure 15:
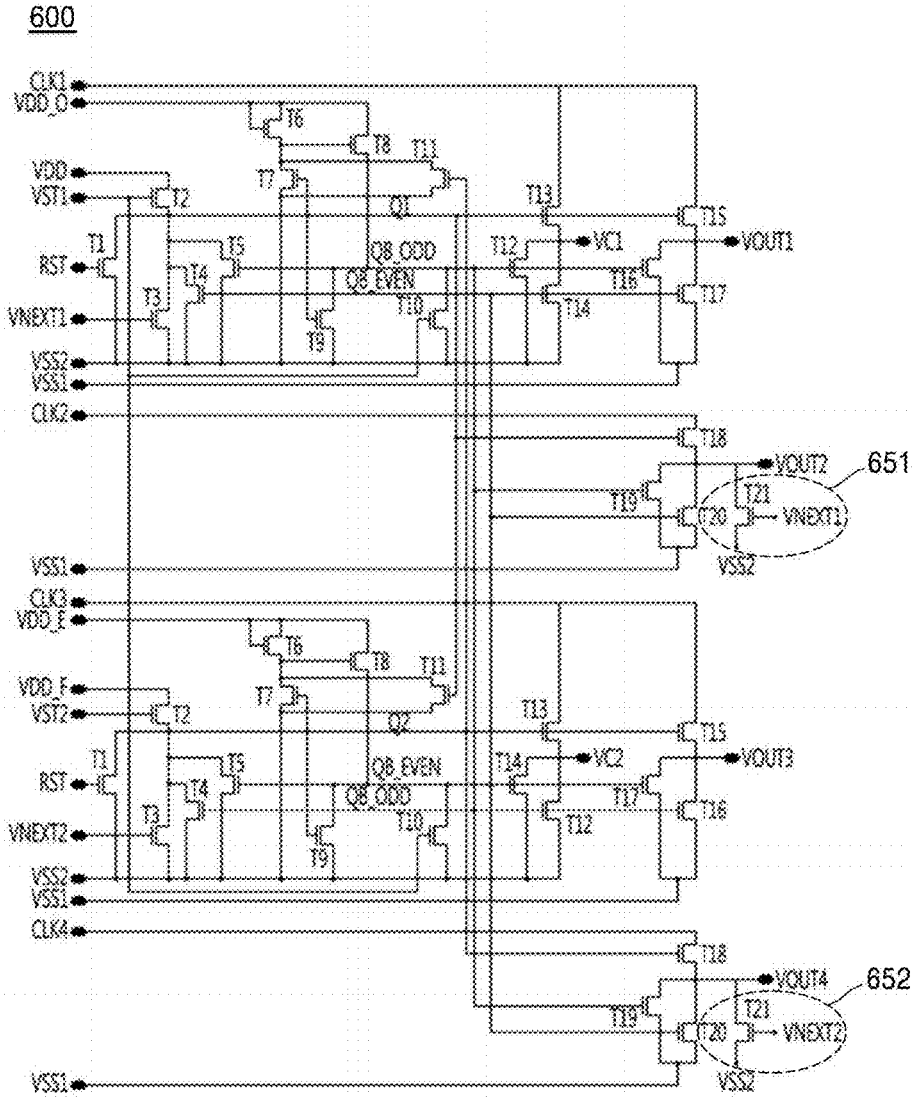
FIG. 15 is a diagram showing a GIP circuit of a display device according to yet another aspect of the present disclosure.
Figure 16:
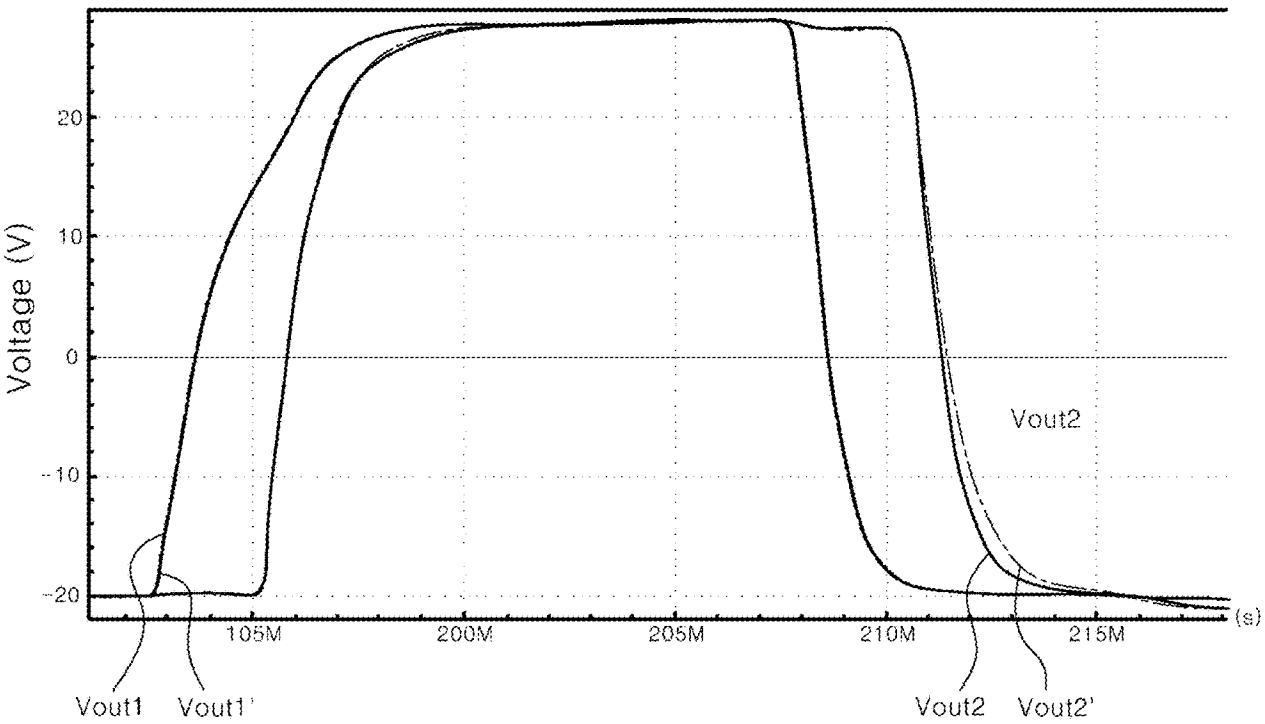
FIG. 16 is a graph showing output characteristics of first and second channels sharing a Q1 node according to yet another aspect of the present disclosure.

FIG. 15 is a diagram showing a GIP circuit of a display device according to yet another aspect of the present disclosure. FIG. 16 is a graph showing output characteristics of first and second channels sharing a Q1 node according to yet another aspect of the present disclosure.

Referring to FIG. 15, a GIP 600 according to another aspect improves the deviation in the output characteristics of the GIP 300 of FIG. 10.

The GIP 600 of FIG. 15 includes all of the elements of the GIP 300 of FIG. 6. In addition, the GIP 600 of FIG. 15 further includes a discharge unit in the $(n+1)^{th}$ channel of the $n^{th}$ channel and the $(n+1)^{th}$ channel sharing a Q node. In addition, the GIP 600 further includes a discharge unit in the $(n+3)^{th}$ channel of the $(n+2)^{th}$ channel and the $(n+3)^{th}$ channel sharing a Q node. For example, the GIP 600 may include four channels, and may include a first discharge unit 651 in the second channel of the first and second channels sharing the Q1 node, and a second discharge unit 652 in the fourth channel of the third and fourth channels sharing the Q2 node. Specifically, the first discharge unit 651 may include a discharge transistor T21. The gate terminal of the discharge transistor T21 of the first discharge unit 651 receives a signal VNEXT1, the source terminal thereof is connected to the output terminal of the pull-up transistor T18 of the second channel, and the drain terminal thereof is connected to the second ground voltage VSS2. Specifically, the second discharge unit 652 may include a discharge transistor T21. The gate terminal of the discharge transistor T21 of the second discharge unit 652 receives a signal VNEXT1, the source terminal thereof is connected to the output terminal of the pull-up transistor T18 of the fourth channel, and the drain terminal thereof is connected to the second ground voltage VSS2.

Referring to FIG. 16, compared to the output voltage VOUT2' of the second channel in the GIP 300 according to the above-described aspect, the falling time of the output voltage VOUT2 of the second channel can be reduced. That is, the falling times of the output voltages VOUT2 and VOUT4 of the second and fourth channels in the GIP 600 can be reduced by the first and second discharge units 651 and 652.

Accordingly, in the GIP 600, the falling times of the output voltages VOUT2 and VOUT4 of the second and fourth channels become close to the falling times of the output voltages VOUT1 and VOUT3 of the first and third channels, and thus deviation in the output can be reduced.

As described above, the area of the gate driver circuit can be decreased while the gate driving signals can be output normally throughout the entire channels of the GIP, such that the size of the bezel can be reduced and the aesthetic design can be improved when the gate driver is employed by UHD/FHD display devices.

In the background art, the size of the bezel is large, such that the number of panels that can be fabricated from a mother substrate at a time is reduced. In contrast, by employing the gate driver according to the aspects of the present disclosure, the number of panels that can be fabricated from a mother substrate at a time is not reduced.

In addition, according to an aspect of the present disclosure, in a GIP type gate driver, deviation in the output characteristics of a plurality of channels can be reduced.

It will be evident to those skilled in the art that various modifications and changes may be made in the aspects of the present disclosure without departing from the technical idea or the gist of the present disclosure. Therefore, it should be understood that the above-described aspects of the disclosure are not limiting but are illustrative in all aspects.

It should be understood that the drawings and the detailed description are not intended to limit the present disclosure to the particular forms disclosed herein, but on the contrary, the intention is to cover all modifications, equivalents, and alternatives falling within the spirit and scope of the present disclosure as defined by the appended claims.

What is claimed is:

1. A gate-in-panel (GIP) type gate driver comprising:

$n^{th}$ to $(n+3)^{th}$ channels configured to sequentially apply scan signals to a plurality of gate lines disposed in a display panel, wherein n is a natural number, wherein the $n^{th}$ and the $(n+1)^{th}$ channels are commonly connected at a Q1 node to share the Q1 node to output a scan signal at high level, the $(n+2)^{th}$ and the $(n+3)^{th}$ channels are commonly connected at a Q2 node to share the Q2 node to output a scan signal at high level, and the $n^{th}$ to $(n+3)^{th}$ channels are commonly connected at a QB node to share the QB node to output a scan signal at low level.

2. The gate driver of claim 1, wherein:

the $n^{th}$ channel comprises a first pull-up transistor configured to output an $n^{th}$ output voltage according to an $n^{th}$ clock signal to an $n^{th}$ gate line as the scan signal at high level, and a first pull-down transistor configured to be turned on by a signal from the QB node to output a first ground voltage; and the $(n+1)^{th}$ channel comprises a second pull-up transistor configured to output an $(n+1)^{th}$ output voltage according to an $(n+1)^{th}$ clock signal as the scan signal at high level to an $(n+1)^{th}$ gate line, and a second pull-down transistor configured to be turned on by the signal from the QB node to output the first ground voltage.

3. The gate driver of claim 1, further comprising first and second compensation units in the $(n+1)^{th}$-channel and the $(n+3)^{th}$ channel compensating for an output deviation in the $(n+1)^{th}$ channel and the $(n+3)^{th}$ channel, respectively.

4. The gate driver of claim 3, wherein the first compensation unit comprises a first compensation capacitor connected to a gate of the second pull-up transistor and a source of the second pull-down transistor in the $(n+1)^{th}$ channel.

5. The gate driver of claim 3, wherein the second compensation unit comprises a second compensation capacitor connected to a gate of the second pull-up transistor and a source of the second pull-down transistor in the $(n+3)^{th}$ channel.

6. The gate driver of claim 1, further comprising first and second discharging units for discharging a high level signal to a low level signal in the $(n+1)^{th}$ channel and the $(n+3)^{th}$ channel, respectively.

7. The gate driver of claim 6, wherein the first discharging unit comprises a first discharging transistor having a gate, a source, and a drain, the gate supplied with a VNEXT1 signal, the source connected to an output terminal of the second pull-up transistor in the $(n+1)^{th}$ channel, and the drain connected to a second ground voltage.

8. The gate driver of claim 6, wherein the second discharging unit comprises a second discharging transistor having a gate, a source, and a drain, the gate supplied with a VNEXT2 signal, the source connected to an output terminal of the second pull-up transistor in the $(n+3)^{th}$ channel, and the drain connected to a second ground voltage.

9. The gate driver of claim 1, wherein the $(n+2)^{th}$ channel comprises a first pull-up transistor configured to output an $(n+2)^{th}$ output voltage according to an $(n+2)^{th}$ clock signal to an $(n+2)^{th}$ gate line as the scan signal at high level, and a first pull-down transistor configured to be turned on by a signal from the QB node to output a first ground voltage; and the $(n+3)^{th}$ channel comprises a second pull-up transistor configured to output an $(n+3)^{th}$ output voltage according to an $(n+3)^{th}$ clock signal as the scan signal at high level to an $(n+3)^{th}$ gate line, and a second pull-down transistor configured to be turned on by the signal from the QB node to output the first ground voltage.

10. A gate-in-panel (GIP) type gate driver comprising:

$n^{th}$ to $(n+3)^{th}$ channels configured to sequentially apply scan signals to a plurality of gate lines disposed on a display panel, wherein n is a natural number, wherein the $n^{th}$ and the $(n+1)^{th}$ channels are commonly connected at a Q1 node to share the Q1 node to output a scan signal at high level, the $(n+2)^{th}$ and the $(n+3)^{th}$ channels are commonly connected at a Q2 node to share the Q2 node to output a scan signal at high level, and the $n^{th}$ to $(n+3)^{th}$ channels are commonly connected at a QB node to share the QB node to output a scan signal at low level, and wherein the $n^{th}$ and the $(n+1)^{th}$ channels respectively include first and second compensation units compensating for an output deviation in the $(n+1)^{th}$ channel and the $(n+3)^{th}$ channel, and first and second discharging units discharging a high level signal to a low level signal in the $(n+1)^{th}$ channel and the $(n+3)^{th}$ channel, respectively.

11. The gate driver of claim 10, wherein:

the $n^{th}$ channel comprises a first pull-up transistor configured to output an nth output voltage according to an nth clock signal to an nth gate line as the scan signal at high level, and a first pull-down transistor configured to be turned on by a signal from the QB node to output a first ground voltage; and the $(n+1)^{th}$ channel comprises a second pull-up transistor configured to output an $(n+1)^{th}$ output voltage according to an $(n+1)^{th}$ clock signal as the scan signal at high level to an $(n+1)^{th}$ gate line, and a second pull-down transistor configured to be turned on by the signal from the QB node to output the first ground voltage.

12. The gate driver of claim 11, wherein the qb node includes an odd number qb node and an even number qb node, which are alternately operated.

13. The gate driver of claim 12, wherein the first compensation unit comprises a first compensation capacitor connected to a gate of the second pull-up transistor and a source of the second pull-down transistor in the $(n+1)^{th}$ channel; and the second compensation unit comprises a second compensation capacitor connected to a gate of the second pull-up transistor and a source of the second pull-down transistor in the $(n+3)^{th}$ channel.

14. The gate driver of claim 12, wherein the odd number QB node and the even number QB node respectively output an signal to turn on an odd number pull-down transistor and an even number pull-down transistor to output the first ground voltage.

15. The gate driver of claim 10, wherein the first discharging unit comprises a first discharging transistor having a gate, a source, and a drain, the gate supplied with a VNEXT1 signal, the source connected to an output terminal of the second pull-up transistor in the $(n+1)^{th}$ channel, and the drain connected to a second ground voltage; and the second discharging unit comprises a second discharging transistor having a gate, a source, and a drain, the gate supplied with a VNEXT2 signal, the source connected to an output terminal of the second pull-up transistor in the $(n+3)^{th}$ channel, and the drain connected to a second ground voltage.

16. A display device comprising:

an array substrate on which a plurality of data lines, a plurality of gate lines and a gate driver are disposed, wherein the gate driver includes $n^{th}$ to $(n+3)^{th}$ channels sequentially supplying scan signals to the plurality of gate lines, where n is a natural number;

a data driver configured to apply data voltages to the plurality of data lines; and a timing controller configured to provide a control signal to the gate driver and the data driver, wherein in the gate driver, the $n^{th}$ and the $(n+1)^{th}$ channels are commonly connected at a Q1 node to share the Q1 node to output a scan signal at high level, the $(n+2)^{th}$ and the $(n+3)^{th}$ channels are commonly connected at a Q2 node to share the Q2 node to output a scan signal at high level, and the $n^{th}$ to $(n+3)^{th}$ channels are commonly connected at a QB node to share the QB node to output a scan signal at low level.

17. The display device of claim 16, further comprising first and second compensation units in the $(n+1)^{th}$ channel and the $(n+3)^{th}$ channel, respectively, wherein the first compensation unit discharges the output terminal of the $(n+1)^{th}$ channel, and the second compensation unit discharges the output terminal of the $(n+3)^{th}$ channel.

18. The display device of claim 17, wherein the first compensation unit comprises a first compensation capacitor connected to a gate of the second pull-up transistor and a source of the second pull-down transistor in the $(n+1)^{th}$ channel; and the second compensation unit comprises a second compensation capacitor connected to a gate of the second pull-up transistor and a source of the second pull-down transistor in the (n+3)th channel.

19. The display device of claim 16, further comprising first and second discharging units in the $(n+1)^{th}$ channel and the $(n+3)^{th}$ channel, respectively, wherein the first discharge unit discharges the output terminal of the $(n+1)^{th}$ channel, and the second discharge unit discharges the output terminal of the $(n+3)^{th}$ channel.

20. The gate driver of claim 19, wherein the first discharging unit comprises a first discharging transistor having a gate, a source, and a drain, the gate supplied with a VNEXT1 signal, the source connected to an output terminal of the second pull-up transistor in the (n+1)th channel, and the drain connected to a second ground voltage; and the second discharging unit comprises a second discharging transistor having a gate, a source, and a drain, the gate supplied with a VNEXT2 signal, the source connected to an output terminal of the second pull-up transistor in the $(n+3)^{th}$ channel, and the drain connected to a second ground voltage.

* * * * *